US007624526B2

(12) United States Patent
Paasikivi et al.

(10) Patent No.: US 7,624,526 B2
(45) Date of Patent: Dec. 1, 2009

(54) RIFLESCOPE

(75) Inventors: Henry Paasikivi, Helsinki (FI); Kari Kuparinen, Topeno (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 11/631,705

(22) PCT Filed: Jul. 7, 2005

(86) PCT No.: PCT/FI2005/050271

§ 371 (c)(1),
(2), (4) Date: Dec. 19, 2007

(87) PCT Pub. No.: WO2006/003265

PCT Pub. Date: Jan. 12, 2006

(65) Prior Publication Data

US 2008/0155877 A1 Jul. 3, 2008

(30) Foreign Application Priority Data

Jul. 7, 2004 (FI) ..... 20040946

(51) Int. Cl.
*F41G 1/52* (2006.01)

(52) U.S. Cl. ..... 42/111; 42/125

(58) Field of Classification Search ..... 42/119–128, 42/95

See application file for complete search history.

(56) References Cited

U.S. PATENT DOCUMENTS

| | | | | |
|---|---|---|---|---|
| 4,247,161 | A | 1/1981 | Unertl, Jr. | |
| 4,297,801 | A | 11/1981 | Kahn | |
| 4,389,791 | A | 6/1983 | Ackerman | |
| 5,513,440 | A | 5/1996 | Murg | |
| 5,557,871 | A * | 9/1996 | LaLonde | 42/95 |
| 6,772,550 | B1 * | 8/2004 | Leatherwood | 42/119 |
| 2002/0078616 | A1 * | 6/2002 | Perry et al. | 42/76.01 |
| 2004/0144013 | A1 | 7/2004 | Leatherwood | |

FOREIGN PATENT DOCUMENTS

| | | |
|---|---|---|
| DE | 4218118 | 12/1993 |

* cited by examiner

*Primary Examiner*—Michael Carone
*Assistant Examiner*—Reginald Tillman, Jr.
(74) *Attorney, Agent, or Firm*—Alfred A. Fressola; Ware, Fressola, Van Der Sluys & Adolphson LLP

(57) ABSTRACT

A riflescope (11), which has an adjusting mechanism (16, 17) for aligning the rifle. By the adjusting mechanism (16, 17) there is provided a code, such as a pointer ring (12, 13, 14, 15) with a color code, according to the scale of which the adjusting mechanism for the riflescope (11) can be adjusted for correcting the ballistic trajectory of a bullet to be fired with the rifle.

15 Claims, 1 Drawing Sheet

1
2
3
4
5
6
7
8

11
12
13
14
15
16
17

12
13
14
15

9
10

10

RIFLESCOPE

CROSS REFERENCE TO RELATED APPLICATIONS

This application is for entry into the U.S. national phase under §371 for International Application No. PCT/F105/050271 having an international filing date of Jul. 7, 2005, and from which priority is claimed under all applicable sections of Title 35 of the United States Code including, but not limited to, Sections 120, 363 and 365(c), and which in turn claims priority under 35 USC §119 to Finnish Patent Application No. 20040946 filed on Jul. 7, 2004.

TECHNICAL FIELD

The present invention relates to a riflescope with an adjusting mechanism for aligning the rifle.

BACKGROUND OF THE INVENTION

At present, the scope has to be realigned each time the barrel is replaced, as more and more rifles with replaceable barrels enter the markets, the rifles having replaceable barrels for different calibres, and a bullet fired with each barrel has its own ballistic trajectory.

SUMMARY OF THE INVENTION

The purpose of the invention is to achieve a new type of a riflescope, which can be adjusted in advance according to the known ballistic trajectory of the bullet to be fired without having to fire the rifle. The riflescope of the invention is characterised in that there is a code, such as a pointer ring with a colour code provided by the adjusting mechanism, the adjusting mechanism of the riflescope being adjustable according to the scale of the ring. By means of the invention, it is thus possible to align the riflescope in a fast and easy manner without firing the rifle.

It is characteristic of an advantageous embodiment of the invention that the lateral adjusting mechanism of the riflescope is provided with a code, such as a pointer ring with a colour code, according to the scale of which the lateral adjusting mechanism of the riflescope can be adjusted for correcting the possible lateral error of the replaceable barrel in the rifle.

Another embodiment of the invention, which is intended for a rifle with replaceable barrels, in which several, even four replaceable barrels of different calibres are used, for example, for 22 LR (long rifle), 22 WMR (Winchester Magnum), 17MACH2, and 17HMR cartridges, is characterised in that the replaceable barrel has a code, for example, a colour ribbon circulating the base of the barrel, and that the rifle stock has respective colour codes with markings indicating which colour corresponds to which calibre.

BRIEF DESCRIPTION OF THE DRAWINGS

The invention will next be described by way of an example, referring to the enclosed drawings, in which FIG. 1 discloses four replaceable barrels of a rifle with replaceable barrels.

DETAILED DESCRIPTION

Figures 1, 2, 3, 4, 5:
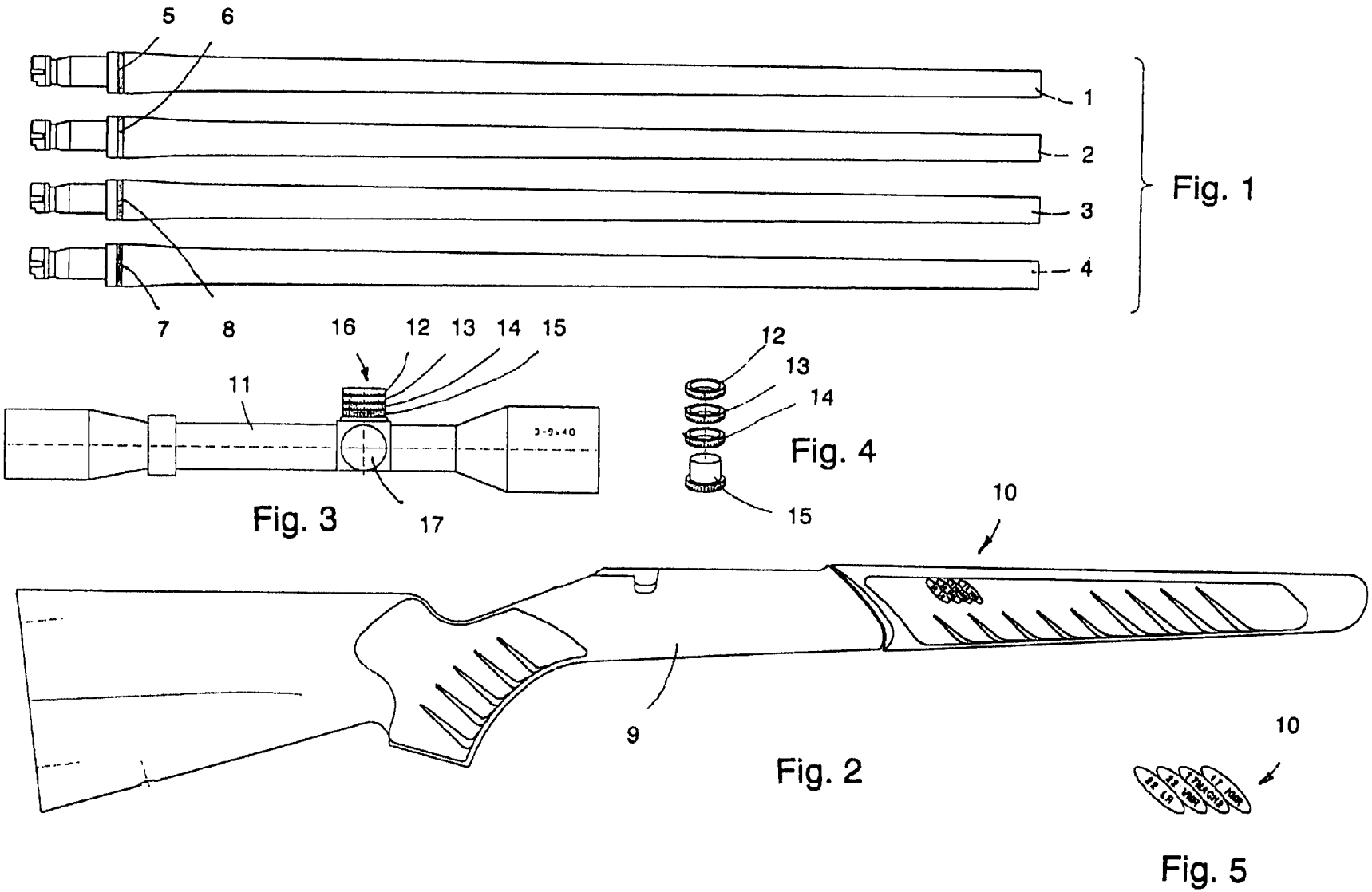
FIG. 2 discloses the stock of a rifle with replaceable barrels.
FIG. 3 discloses a riflescope.
FIG. 4 discloses the pointer rings with colour codes of the height adjustment system for a riflescope.
FIG. 5 discloses the colour code markings in the side of the stock of FIG. 2.

The riflescope is primarily intended for a rifle with replaceable barrels, in which several, in this case even as many as four replaceable barrels of different calibres (1, 2, 3, 4) are used, for example, for 22 LR, 22 WMR, 17MACH2, and 17 HMR cartridges. The replaceable barrel 1, 2, 3, 4 has the code 5, 6, 7, 8, such as a colour ribbon circulating the base of the barrel. The rifle stock 9 has the respective colour codes 10, which bear markings on which colour corresponds to which calibre. The pointer rings 12, 13, 14, 15 by the adjusting mechanism have the similar colour code as the barrel 1, 2, 3, 4 and the stock 9.

The riflescope 11 is first aligned to a rifle having, for example, a basic barrel 4, a calibre 22 LR, and a colour code. A basic ring 15 with a similar colour code is installed to the riflescope, the scale of the basic ring being adjusted to zero by the adjusting screw 16 of the adjusting mechanism. The pointer ring 15 is tightened by a locking screw. The next barrel 3, for example, calibre 22 WMR, is replaced, the riflescope is aligned, the next colour ring 14 is adjusted to zero by the pointer of the adjusting screw 16 and fastened by the locking ring. The same measures are performed with the next barrel 2, calibre 17 MACH2, the colour ring 13 is tightened by the pointer of the adjusting screw 16 and the same measures are finally performed with the last barrel 1, calibre 17 HMR, the riflescope is aligned and the last colour ring 12 is fastened by the pointer of the adjusting screw. Each colour ring 12, 13, 14, 15 has now been adjusted for the barrel 1, 2, 3, 4 provided with the respective colour code. Respectively, the lateral deviations of the riflescope will be aligned by using the adjusting screw 17, if necessary.

The riflescope of the invention is also suited for rifles which have no replaceable barrel system, but which rifle is used for firing bullets of different weights. Bullets with different weights also have different ballistic trajectories. The user of the rifle can himself stick the colour codes and cartridge identifiers corresponding with the ring colours in the riflescope, for example, to the rifle stock, cartridge pocket, belt, or some other suitable place.

The code need not necessarily be a coloured pointer ring, but it can as well be a code card containing the data, how much or how many steps the screw of the adjusting mechanism be turned either right or left, when replacing a barrel or cartridge with a second barrel or cartridge with its own ballistic trajectory.

What is claimed is:

1. A riflescope for use on a rifle, comprising an adjusting mechanism for aligning the riflescope, wherein the adjusting mechanism is provided a code, according to a scale of which the adjusting mechanism of the riflescope can be adjusted, the code corresponding to a code of replaceable barrels of different caliber.

2. The riflescope according to claim 1, wherein the adjusting mechanism includes a lateral adjusting mechanism for the riflescope provided with a code, according to the scale of which the lateral adjusting mechanism for the riflescope can be adjusted for correcting possible lateral error of the replaceable barrel in the rifle.

3. The riflescope according to claim 2, intended for a rifle with a replaceable barrel, in which several replaceable barrels of different calibres are used, wherein each replaceable barrel has a code, and that a rifle stock of said rifle has a respective code with markings which corresponds to the caliber of the corresponding replaceable barrel.

4. The riflescope according to claim 1, wherein the adjusting mechanism code is a pointer ring with a color code.

5. The riflescope according to claim 2, wherein the lateral adjusting mechanism code is a pointer ring with a color code.

6. The riflescope according to claim 3, wherein the code of each of said replaceable barrels has a color ribbon circulating a barrel base of said replaceable barrel and wherein the rifle stock respective code is a color code with markings which color correspond to the caliber of the corresponding replaceable barrel.

7. The riflescope according to claim 3, wherein the caliber of said replaceable barrels are selected from a group including 22LR, 22WMR, 17 MACH2 and 17HMR.

8. The riflescope of claim 3, wherein the adjusting mechanism code is a pointer ring with a color code.

9. The riflescope according to claim 1, intended for a rifle with a replaceable barrel, in which several replaceable barrels of different calibres are used, wherein each replaceable barrel has a code, and that a rifle stock of said rifle has a respective code with markings which corresponds to the caliber of the corresponding replaceable barrel.

10. The riflescope according to claim 9, wherein the code of each of said replaceable barrels has a color ribbon circulating a barrel base of said replaceable barrel and wherein the rifle stock respective code is a color code with markings which color correspond to the caliber of the corresponding replaceable barrel.

11. The riflescope according to claim 9, wherein the caliber of said replaceable barrels are selected from a group including 22LR, 22WMR, 17 MACH2 and 17HMR.

12. The riflescope of claim 9, wherein the adjusting mechanism code is a pointer ring with a color code.

13. The riflescope according to claim 12, wherein each pointer ring has a similar code as the barrel and the stock.

14. The riflescope according to claim 4, wherein the adjusting mechanism includes a lateral adjusting mechanism for the riflescope provided with a code, according to the scale of which the lateral adjusting mechanism for the riflescope can be adjusted for correcting possible lateral error of the replaceable barrel in the rifle.

15. The riflescope according to claim 8, wherein each pointer ring has a similar code as the barrel and the stock.

* * * * *